United States Patent [19]

Davis

[11] 4,014,285

[45] Mar. 29, 1977

[54] MEMO DEVICE

[75] Inventor: Charles W. Davis, Ontario, Canada

[73] Assignee: The Raymond Lee Organization, Inc., New York, N.Y. ; a part interest

[22] Filed: May 13, 1976

[21] Appl. No.: 686,231

[52] U.S. Cl. ..... 116/131; 40/308; 116/133; 116/135; 281/30

[51] Int. Cl.[2] ..... G09F 19/06

[58] Field of Search ..... 116/133, 135, 114 R, 116/131, 130; 40/308, 28 A; 281/30

[56] References Cited

UNITED STATES PATENTS

| | | | |
|---|---|---|---|
| 457,204 | 8/1891 | Klauser | 40/133 |
| 1,290,988 | 1/1919 | Hawxhurst | 116/131 |
| 3,530,818 | 9/1970 | Secondino | 116/133 |
| 3,728,807 | 4/1973 | Jameson | 116/133 |
| 3,918,635 | 9/1974 | Gilomen | 116/135 |

FOREIGN PATENTS OR APPLICATIONS

| | | | |
|---|---|---|---|
| 312,615 | 1/1956 | Switzerland | 116/133 |
| 226,866 | 1/1925 | United Kingdom | 116/135 |

*Primary Examiner*—S. Clement Swisher
*Assistant Examiner*—Denis E. Corr
*Attorney, Agent, or Firm*—Daniel Jay Tick

[57] ABSTRACT

A guide device is provided along an edge of a plate-like member. A plurality of blocked spaces on the member extend alongside the guide device. A pointer is movably mounted in the guide means for manually selecting a desired one of the blocked spaces. A first knob is rotatably mounted on the member on one side of the blocked spaces in a plane perpendicular to the plane of the member. The knob has marks around its circumference indicating the hours and minutes of a day. A second knob is rotatably mounted on the member on the opposite side of the blocked spaces in a plane perpendicular to the plane of the member. The knob has marks around its circumference indicating the hours and minutes of a day. A writing instrument is provided on the member for writing messages in the blocked spaces whereby the pointer is movable to a selected blocked space bearing a pertinent message, the first knob is settable to indicate a time of departure relative to the pertinent message and the second knob is settable to indicate a time of return relative to the pertinent message.

1 Claim, 2 Drawing Figures

MEMO DEVICE

DESCRIPTION OF THE INVENTION

The present invention relates to a memo device.

Objects of the invention are to provide a memo device of simple structure, which is inexpensive in manufacture, used with facility and convenience, and functions efficiently, effectively and reliably to provide a message indicating where the writer has gone, what time he or she left and what time he or she expects to return.

In order that the invention may be readily carried into effect, it will now be described with reference to the accompanying drawing, wherein.

Figure 1:
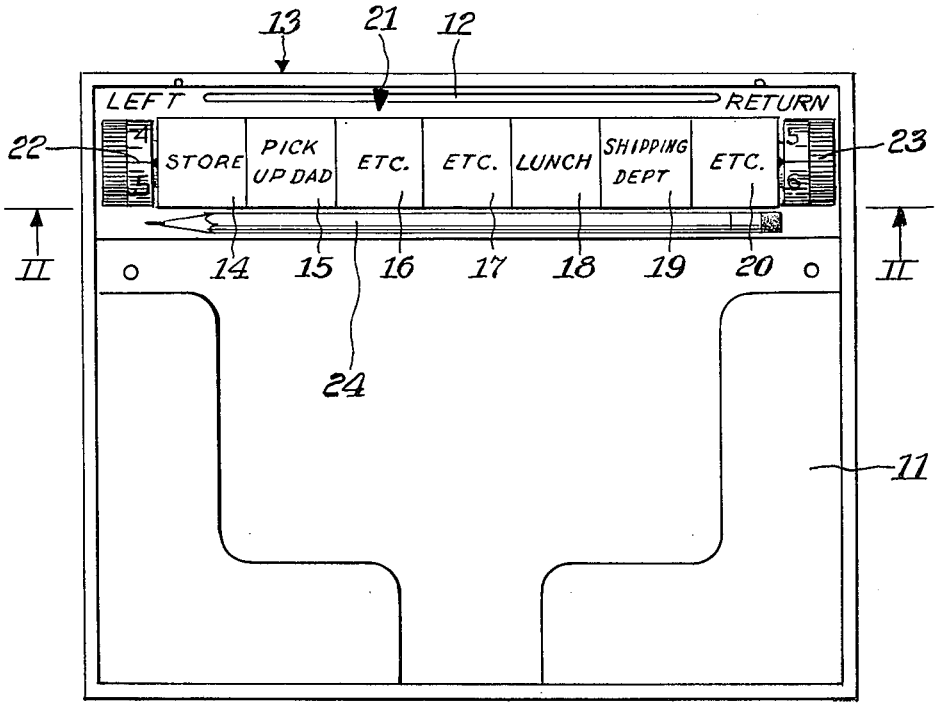
FIG. 1 is a top plan of an embodiment of the memo device of the invention.
Figure 2:
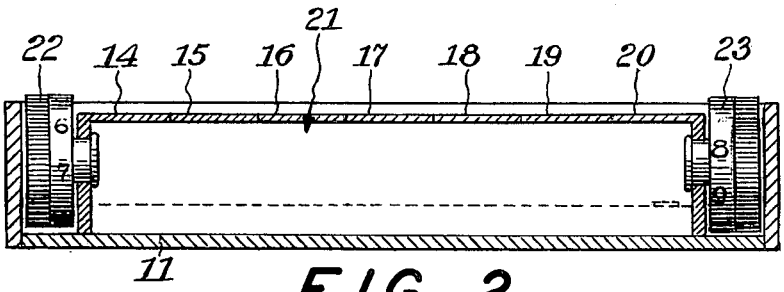
FIG. 2 is a cross-sectional view, taken along the lines II—II, of FIG. 1.

The memo device of the invention comprises a substantially plate-like member 11. A guide slot or protrusion 12 (FIG. 1) is provided along an edge 13 of the member 11.

A plurality of block spaces 14, 15, 16, 17, 18, 19 and 20 are provided on the member 11 extending alongside the guide slot or protrusion 12.

A pointer 21 is movably mounted in the guide slot 12 or on the guide protrusion 12 for manually selecting a desired one of the block spaces 14 to 20.

Thus, the user writes different appropriate or pertinent messages in each of the block spaces 14 to 20 and moves the pointer 21 to the appropriate message.

A first knob 22 is rotatably mounted on the member 11 on one side of the block spaces 14 to 20 in a plane substantially perpendicular to the plane of the member 11. The first knob 22 has marks around its circumference indicating the hours and minutes of a day.

A second knob 23 is rotatably mounted on the member on the opposite side of the block spaces 14 to 20 in a plane substantially perpendicular to the plane of the member 11. The second knob 23 has marks around its circumference indicating the hours and minutes of the day.

Thus, the first knob 22 is rotated until it indicates the time that the person leaving the message departed relative to said message. In other words, the person indicates the time he or she departed on the errand indicated. The person leaving the message rotates the knob 23 until it indicates the time that he or she expects to return relative to said message. In other words, the person indicates the time he or she expects to return from the errand indicated by the pointer 21.

A writing instrument 24 (FIG. 1) of any suitable known type such as, for example, a pencil or pen, is provided on the member for writing messages in the block spaces 14 to 20.

The block spaces 14 to 20 consist of a pad of a plurality of paper inserts which are either preprinted or written in the most frequently used designations by the user.

The lower three quarters of the device is filled with note paper for writing additional messages. The note paper may be backed by a spring-biased plate which urges the paper toward the top of the device and provides a firm writing surface.

While the invention has been described by means of a specific example and in a specific embodiment, I do not wish to be limited thereto, for obvious modifications will occur to those skilled in the art without departing from the spirit and scope of the invention.

I claim:

1. A memo device, comprising a substantially plate-like member;

guide means along an edge of the member;

a plurality of blocked spaces on the member extending alongside the guide means;

a pointer movably mounted in the guide means for manually selecting a desired one of the blocked spaces;

a first knob rotatably mounted on the member on one side of the blocked spaces in a plane substantially perpendicular to the plane of the member, said knob having marks around its circumference indicating the hours and minutes of a day;

a second knob rotatably mounted on the member on the opposite side of the blocked spaces in a plane substantially perpendicular to the plane of the member, said second knob having marks around its circumference indicating the hours and minutes of a day; and a writing instrument on the member for writing messages in the blocked spaces whereby the pointer is movable to a selected blocked space bearing a pertinent message, the first knob is settable to indicate a time of departure relative to the pertinent message and the second knob is settable to indicate a time of return relative to said pertinent message.

* * * * *